US007766675B2

(12) United States Patent
Suzuki

(10) Patent No.: US 7,766,675 B2
(45) Date of Patent: Aug. 3, 2010

(54) CONNECTOR

(75) Inventor: Sachio Suzuki, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/552,588

(22) Filed: Sep. 2, 2009

(65) Prior Publication Data

US 2010/0055982 A1 Mar. 4, 2010

(30) Foreign Application Priority Data

Sep. 2, 2008 (JP) ..... 2008-224445

(51) Int. Cl.
*H01R 4/66* (2006.01)

(52) U.S. Cl. ..... 439/98; 439/607.5

(58) Field of Classification Search ..... 439/98, 439/607.41, 607.48, 607.5, 878, 882
See application file for complete search history.

(56) References Cited

U.S. PATENT DOCUMENTS 6,524,121 B2 * 2/2003 Kanagawa ..... 439/98
6,530,789 B2 * 3/2003 Konda ..... 439/98
2009/0258531 A1 10/2009 Oka

FOREIGN PATENT DOCUMENTS

JP 2007-103087 4/2007
JP 2008-102366 5/2008
JP 2009-252682 10/2009

* cited by examiner

*Primary Examiner*—Tho D Ta
(74) *Attorney, Agent, or Firm*—Antonelli, Terry, Stout & Kraus, LLP.

(57) ABSTRACT

According to the present invention, there is provided a connector for a cable whose conductor is covered with an insulator and a braided shield. The present invention's connector includes: a housing including a shield, the shield being configured to be electrically connected to the braided shield of the cable; and a ferrule housed in the housing and configured to be connected to the cable, the ferrule including: a swaging portion that is configured to be swaged onto the cable and to provide electrical connection to the braided shield; and two spring portions provided on opposite sides of the swaging portion along the cable axial direction, each spring portion being in contact with the shield of the housing, the two spring portions being configured to fix the swaging portion and the cable in the housing.

4 Claims, 4 Drawing Sheets

CONNECTOR

CLAIM OF PRIORITY

The present application claims priority from Japanese patent application serial no. 2008-224445 filed on Sep. 2, 2008, the content of which is hereby incorporated by reference into this application.

BACKGROUND OF THE INVENTION

1. Field of the Invention

The present invention relates to connectors for connecting an apparatus and a cable, and particularly to connectors used under the conditions of vibration, such as in vehicles.

2. Description of Related Art

In vehicles and other applications, connectors are commonly used for connecting an apparatus (such as a power converter) and a cable. FIGS. 4 and 5 illustrate a conventional connector structure. As shown, the connector includes: a male connector to be connected to an electric apparatus; and a female connector to be connected to a cable 16. FIGS. 4 and 5 illustrate how the male and female connectors are connected to each other. The male connector includes an outer housing 1, an inner housing 2, and a male terminal 3. The female connector includes an outer housing 4, an inner housing 5, and a female terminal 6. The outer housing 4 of the female connector is made of aluminum and has an opening through which the cable 16 is inserted.

As shown in FIG. 4, the female connector further includes a lever 10 for facilitating fitting; a CPA (connector position assurance) 11 for fixing the lever 10 in position after the completion of the fitting; a sealing ring 12 for providing waterproofing between the male and female connectors; a wire seal 13 for providing waterproofing between the cable 16 and the outer housing 4; and a tail plate 14 for holding the wire seal 13.

The cable 16 is provided with a braided shield, and an outer ferrule 30 is swaged onto the braided shield in order to provide electrical connection between the braided shield and the outer housing 4. FIG. 6 is a schematic illustration showing a perspective view of an outer ferrule of a conventional connector. As shown in FIG. 6, the outer ferrule 30 includes a cable-swaging portion 31 for swaging the outer ferrule 30 onto the braided shield of the cable 16 and a spring portion 32 for providing contact to the outer housing 4.

When the connector is mounted in a place subject to vibration (such as in a vehicle), the cable 16 connected to the connector will suffer from vibration. In such a case, the vibration propagates to the female terminal 6 of the female connector connected to the cable 16, causing friction at the contact between the male terminal 3 and the female terminal 6. This will cause undesirable effects such as abrasion of the contact surface platings, thus increasing the contact resistance between the male terminal 3 and the female terminal 6.

FIG. 7 is a schematic illustration showing a longitudinal-sectional view of the FIG. 6 outer ferrule. More specifically, in the conventional connector shown in FIG. 7, the cable 16 contacts the female outer housing 4 of the connector via several bumps 33 spaced along an outer perimeter of the spring portion 32 of the outer ferrule 30. This configuration has, in the circumferential direction, multiple contact points between the spring portion 32 and the outer housing 4, but it has only one contact point in the longitudinal direction. Therefore, as shown by the broken line of FIG. 7, the cable 16 can swing about one of the contact points between the spring portion 32 and the outer housing 4 (i.e., the contact point functions as the pivot point of the swing), thus causing a vibration of the cable 16 to propagate to the female terminal 6. Such a vibration will in turn increase the contact resistance between the male terminal 3 and the female terminal 6.

To solve this problem, JP-A-2007-103087 discloses a connector which can prevent any vibration of a cable from directly propagating to its terminal.

SUMMARY OF THE INVENTION

Under these circumstances, it is an objective of the present invention to solve the foregoing problem and to provide a connector which can minimize abrasion of the contact surfaces between the male and female terminals even in environments of vibration such as in vehicles.

According to one aspect of the present invention, there is provided a connector for a cable whose conductor is covered with an insulator and a braided shield. The present invention's connector includes: a housing including a shield, the shield being configured to be electrically connected to the braided shield of the cable; and a ferrule housed in the housing and configured to be connected to the cable, the ferrule including: a swaging portion that is configured to be swaged onto the cable and to provide electrical connection to the braided shield; and two spring portions provided on opposite sides of the swaging portion along the cable axial direction, each spring portion being in contact with the shield of the housing, the two spring portions being configured to fix the swaging portion and the cable in the housing.

In the above aspect of the present invention, the following modifications and changes can be made.

(i) The shield of the housing has cylinder portions, each cylinder portion surrounding a corresponding one of the spring portions; each spring portion is a cylinder generally conformal to the corresponding cylinder portion of the shield of the housing; each cylinder-shape spring portion has three or more cuts along its axial direction to provide three or more leaf springs; and each leaf spring is resiliently in contact with the corresponding cylinder portion of the shield of the housing.

(ii) The housing is made of aluminum.

ADVANTAGES OF THE INVENTION

The present invention can minimize abrasion of the contact surfaces between the male and female terminals even in environments of vibration such as in vehicles.

DETAILED DESCRIPTION OF THE PREFERRED EMBODIMENTS

A preferred embodiment of the present invention will be described below with reference to the accompanying drawings. However, the present invention is not limited to the embodiments described herein.

Figure 1:
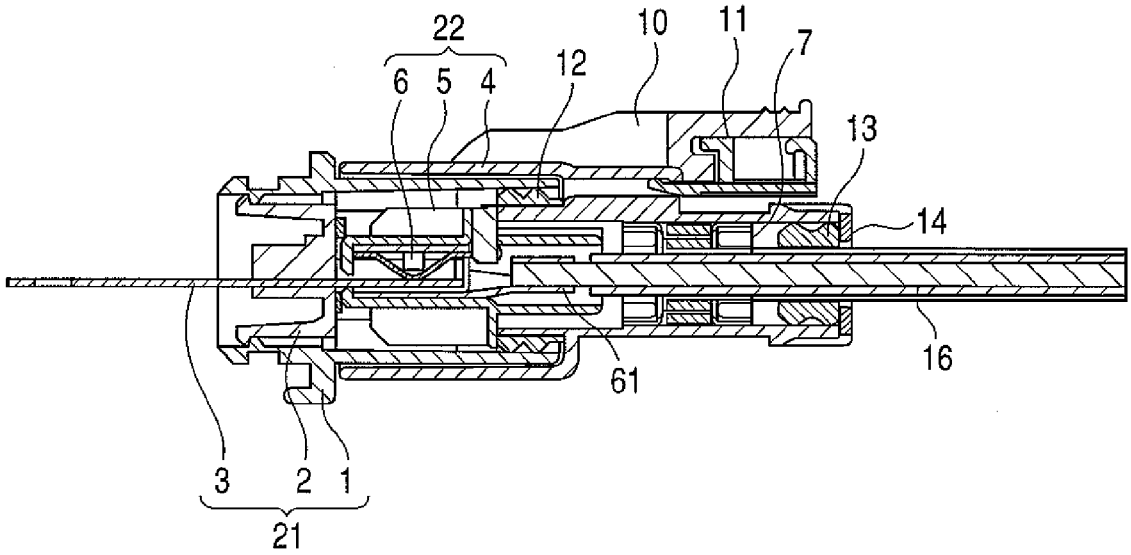
FIG. 1 is a schematic illustration showing a longitudinal-sectional view of a connector according to an embodiment of the present invention.
Figure 4:
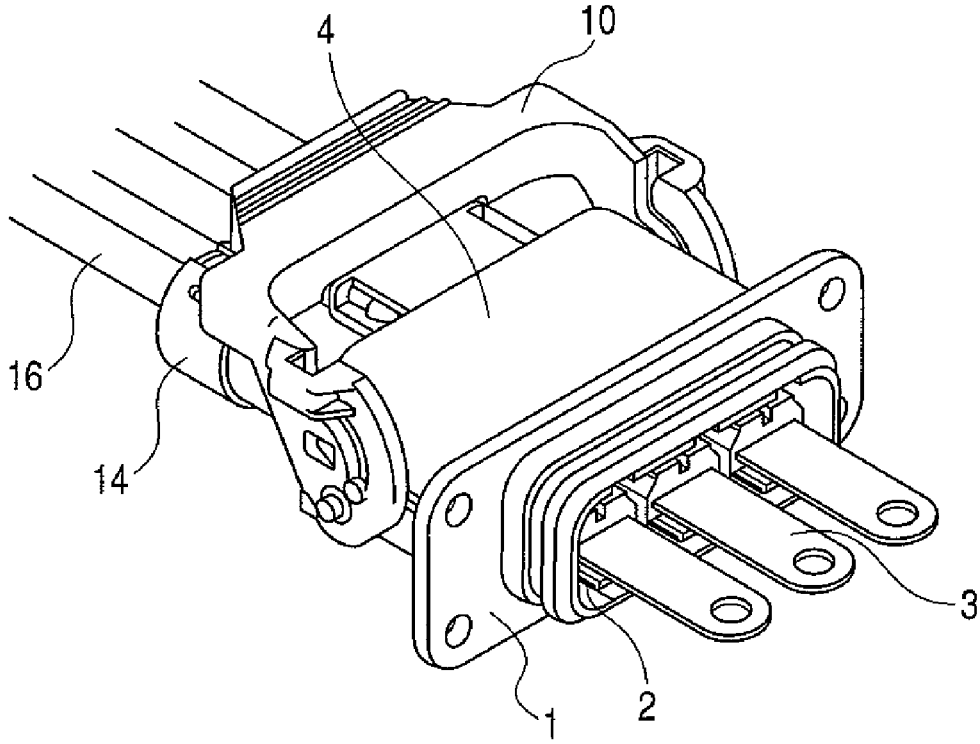
FIG. 4 is a schematic illustration showing a perspective view of a connector structure.
Figure 5:
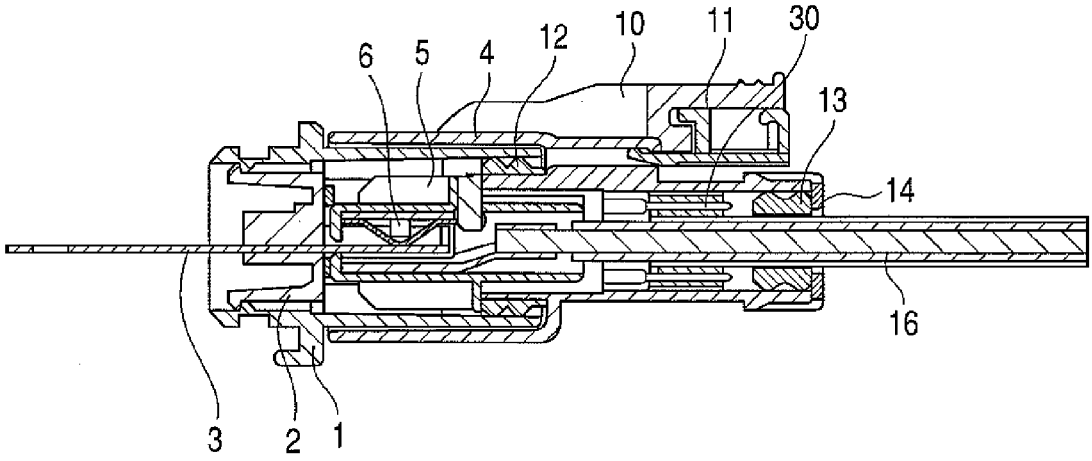
FIG. 5 PRIOR ART
FIG. 5 is a schematic illustration showing a longitudinal-sectional view of a conventional connector structure.
Figure 6:
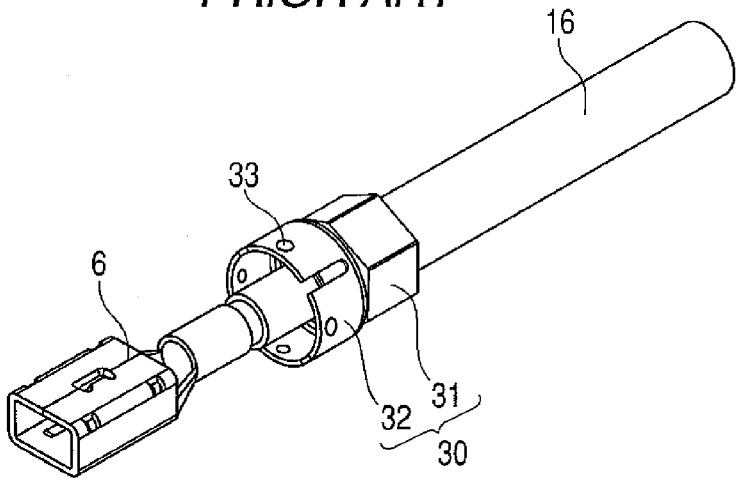
FIG. 6 PRIOR ART
FIG. 6 is a schematic illustration showing a perspective view of an outer ferrule of a conventional connector.
Figure 7:
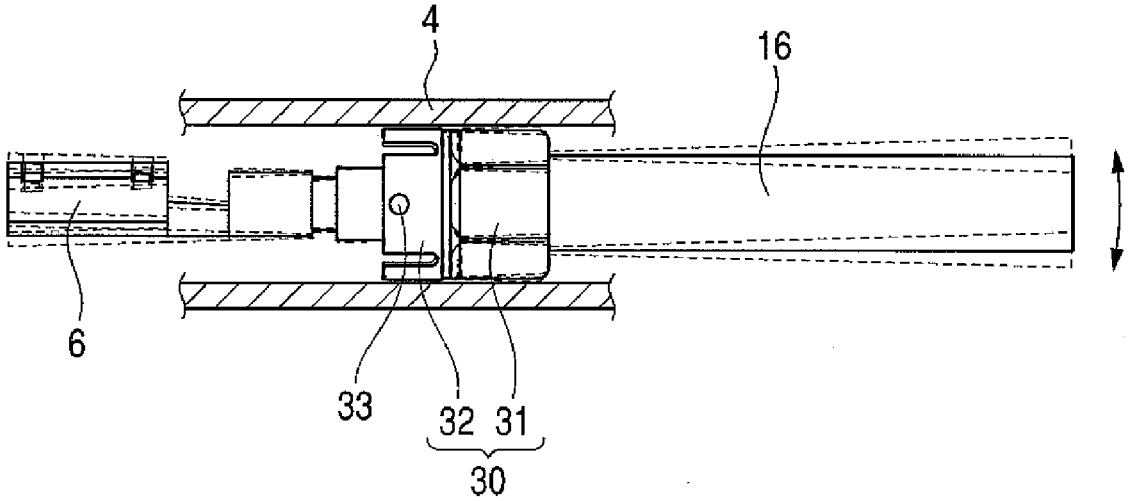
FIG. 7 PRIOR ART
FIG. 7 is a schematic illustration showing a longitudinal-sectional view of the FIG. 6 outer ferrule.

FIG. 1 is a schematic illustration showing a longitudinal-sectional view of a connector according to the present embodiment. The outer shape of this embodiment's connector is generally similar to that of the conventional connector described in, e.g., FIG. 4. Parts with the same function as in FIG. 4 are designated by the same reference numerals as used in FIG. 4. FIG. 1 illustrates how male and female connectors are connected to each other.

As shown in FIG. 1, the embodiment's connector includes an apparatus-side connector (first connector) 21 which is to be mounted and connected to an electric apparatus, and a cable-side connector (second connector) 22 that is to be mounted and connected to a cable. In the apparatus-side connector 21, the outer wall of a male tab terminal 3 is fixedly surrounded by a male inner housing 2 made of an insulator resin and the housing 2 is fixed to a male outer housing 1 made of aluminum.

In the cable-side connector 22, the outer wall of a receptacle-contact female terminal 6 is fixedly surrounded by a female inner housing 5 made of an insulator resin and the housing 5 is fixed to a female outer housing 4 made of aluminum. The female terminal 6 and male terminal 3 are contacted to each other by an appropriate contacting force supplied by a spring structure provided in the female terminal 6. The cable-side connector 22 further includes a lever 10 for mechanically assisting connection between the male terminal 3 and the female terminal 6, and a CPA (connector position assurance) for fixing the lever 10 in position after the completion of the connection (see FIG. 4).

A cable 16 is a shielded cable whose conductor is sequentially covered with an insulator resin, a braided shield and a sheath. A barrel 61 of the female terminal 6 is swaged to the conductor of the cable 16, thereby providing electrical connection therebetween. The braided shield is electrically connected to the female outer housing 4 via an outer ferrule 7. A sealing ring 12 for waterproofing is provided inside the female outer housing 4 of the cable-side connector 22. The sealing ring 12 is compressed by both the male outer housing 1 and the female outer housing 4 when the apparatus-side connector 21 is fitted to the cable-side connector 22, thereby providing the waterproofing effect. Between the cable 16 and the female outer housing 4 is provided a wire seal 13 and a tail plate 14 for holding the wire seal 13, thereby waterproofing the interior of the housing 4.

Figure 2:
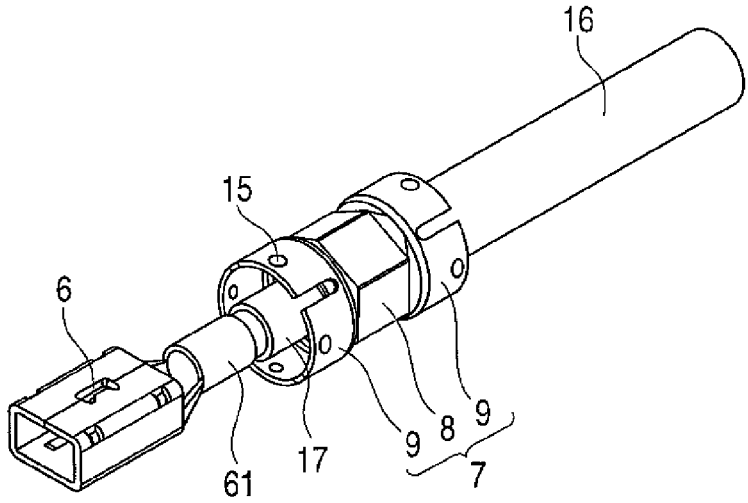
FIG. 2 is a schematic illustration showing a perspective view of the outer ferrule of the FIG. 1 connector.
Figure 3:
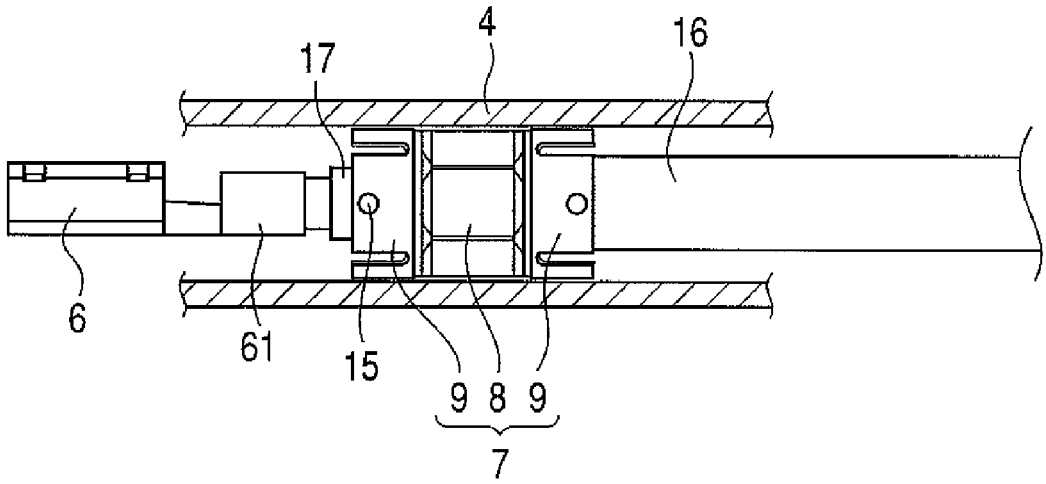
FIG. 3 is a schematic illustration showing a longitudinal-sectional view of the FIG. 2 outer ferrule.

FIGS. 2 and 3 are schematic illustrations showing perspective and longitudinal-sectional views of the outer ferrule 7 of the embodiment's connector, respectively. As shown, the outer ferrule 7 includes a cable swaging portion 8 (henceforth referred to as "swaging portion 8") for swaging onto the cable 16, and spring portions 9 provided on the opposite (both) sides of the swaging portion 8 along the cable axial direction.

The swaging portion 8 is a cylinder having a cylindrical inner wall and is made of an electrically conductive material. An inner ferrule 17 is provided around the outer wall of a portion of the sheath of the cable 16, and the braided shield of the cable 16 is folded back over the inner ferrule 17. Then, the swaging portion 8 is placed around the thus folded braided shield and is swaged onto the braided shield into a polygonal outer shape (hexagonal in the figure), thereby providing electrical connection to the braided shield.

Each spring portion 9 is provided around the outer wall of a portion of the cable 16 and is a leaf spring having a cylindrical shape generally conformal to the cylindrical inner wall of the female outer housing 4. With this configuration, each spring portion 9 resiliently contacts the cylindrical inner wall of the female outer housing 4. Specifically, each spring portion 9 has cuts along the longitudinal (axial) direction of the cable 16, and thereby three or more separate leaf springs are formed. Each leaf spring has a bump 15 formed on its outer surface. Via the bumps 15, each spring portion 9 is always in contact with the inner wall (the shield) of the female outer housing 4 after it has been inserted in the housing 4. Thus, the braided shield of the cable 16 is electrically connected to the shield of the female outer housing 4 via the swaging portion 8 and the spring portions 9.

In the connector according to this embodiment, the outer ferrule 7 is configured with the spring portions 9 provided on the opposite (both) sides of the swaging portion 8 along the cable axial direction, and thus the cable 16 is in contact with and is supported by the female outer housing 4 via the two spring portions 9 provided at two positions along the length of the cable 16. Therefore, in the embodiment's connector, any vibration generated in the cable 16 can be prevented from propagating to the female terminal 6, thus improving the vibration resistance of the connector. Hence, the embodiment's connector can minimize abrasion of the contact surfaces between the male and female terminals even under circumstances of vibration such as in vehicles.

Furthermore, in the present invention's outer ferrule 7, the two spring portions 9 (provided on the opposite (both) sides of the swaging portion 8) are integral with the swaging portion 8, and therefore can be simultaneously fixed to the cable 16 by swaging the swaging portion 8 to the cable 16 only once. Thus, the manufacturing efficiency is high compared to methods in which each spring portion needs to be fixed by a separate swaging operation. Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A connector for a cable whose conductor is covered with an insulator and a braided shield, the connector comprising:

a housing including a shield, the shield being configured to be electrically connected to the braided shield of the cable; and a ferrule housed in the housing and configured to be connected to the cable, the ferrule including:

a swaging portion that is configured to be swaged onto the cable and to provide electrical connection to the braided shield; and two spring portions provided on opposite sides of the swaging portion along the cable axial direction, each spring portion being in contact with the shield of the housing, the two spring portions being configured to fix the swaging portion and the cable in the housing.

2. The connector according to claim 1, wherein:

the shield of the housing has cylinder portions, each cylinder portion surrounding a corresponding one of the spring portions, and wherein:

each spring portion is a cylinder generally conformal to the corresponding cylinder portion of the shield of the housing; each cylinder-shape spring portion has three or more cuts along its axial direction to provide three or more leaf springs; and each leaf spring is resiliently in contact with the corresponding cylinder portion of the shield of the housing.

3. The connector according to claim 1, wherein:

the housing is made of aluminum.

4. A connector structure comprising:

a first connector configured to be connected to an electric device; and a second connector configured to be connected to a cable, the second connector being the connector of claim 1.

* * * * *